United States Patent [19]

Sendoykas

[11] Patent Number: 5,020,418

[45] Date of Patent: Jun. 4, 1991

[54] PISTON LOCK FOR POWER CYLINDERS

[76] Inventor: Jack J. Sendoykas, 23510 Denton, Apt. 227 T, Mt. Clemens, Mich. 48043

[21] Appl. No.: 388,481

[22] Filed: Aug. 2, 1989

[51] Int. Cl.[5] ..... F15B 15/26

[52] U.S. Cl. ..... 92/17; 92/20; 92/28; 92/29

[58] Field of Search ..... 92/15, 17, 18, 20, 23, 92/27, 28, 29

[56] References Cited

U.S. PATENT DOCUMENTS

| | | | |
|---|---|---|---|
| 2,773,485 | 12/1956 | Geyer | 121/40 |
| 2,815,005 | 12/1957 | Geyer | 121/40 |
| 2,886,008 | 5/1959 | Geyer et al. | 121/41 |
| 2,918,786 | 12/1959 | Geyer | 60/6 |
| 2,970,573 | 2/1961 | Geyer | 121/40 |
| 3,236,489 | 2/1966 | Mattocks et al. | 91/461 |
| 3,576,151 | 4/1971 | Sendoykas | 92/24 |
| 3,668,977 | 6/1972 | Beidler | 92/17 |
| 3,702,535 | 11/1972 | House | 92/15 |
| 3,732,783 | 5/1973 | Emenaker | 91/44 |
| 3,763,747 | 10/1973 | Beichel et al. | 92/33 |
| 4,196,654 | 4/1980 | Stearns | 92/33 |
| 4,462,768 | 7/1984 | Westmoreland | 417/518 |
| 4,790,234 | 12/1988 | Hampejs et al. | 91/362 |

FOREIGN PATENT DOCUMENTS

| | | | |
|---|---|---|---|
| 24680 | 2/1977 | Japan | 92/28 |

*Primary Examiner*—John T. Kwon
*Assistant Examiner*—F. Daniel Lopez
*Attorney, Agent, or Firm*—Krass & Young

[57] ABSTRACT

A power cylinder of the type in which the piston may be locked to maintain the associated tool or clamp in a fixed position. A pair of guide rods extend in parallel spaced fashion through the bore of the cylinder from end to end of the cylinder and the piston includes a pair of spaced apertures passing the guide rods so that the piston may slide within the bore of the cylinder on the guide rods. The piston apertures are internally threaded and the guide rods include an externally threaded portion so that, following movement of the piston within the bore through a rapid advance portion of its stroke under the influence of pressure fluid, the internal threads in the piston apertures are brought into engagement with the externally threaded portions of the guide rods and the guide rods are thereafter rotated so as to threadably advance the piston to its final desired position in which the piston is lockingly held by the coacting threads. Rotation of the guide rods is achieved in one embodiment by a rack and pinion arrangement and is achieved in another embodiment by an air motor.

18 Claims, 4 Drawing Sheets

FIG - 1
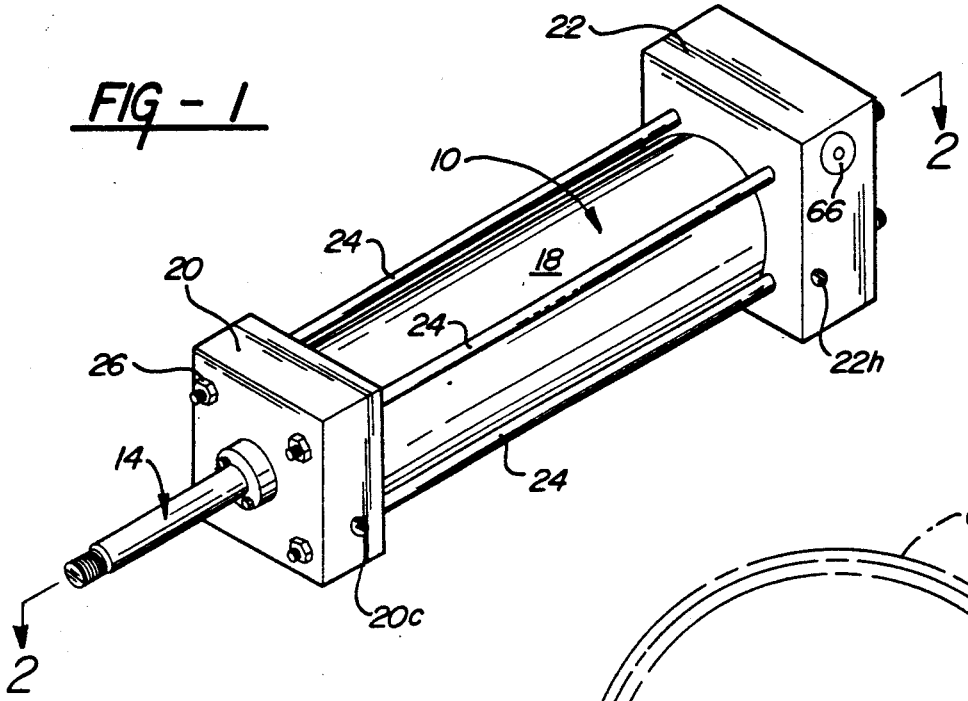
FIG - 6
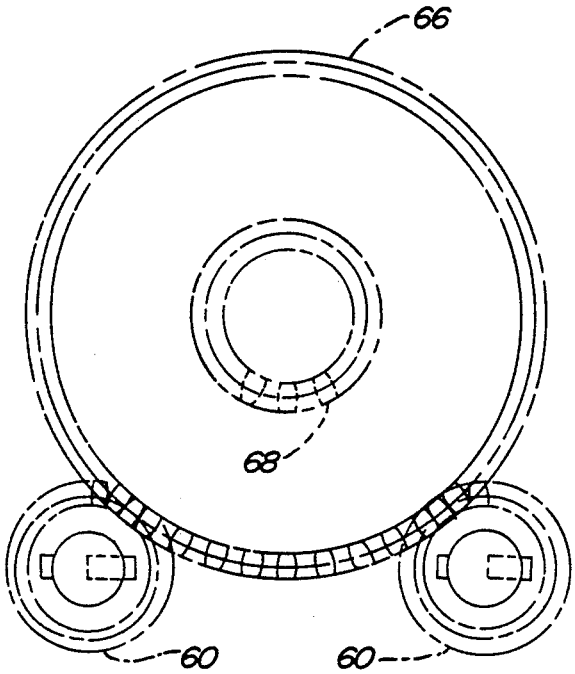
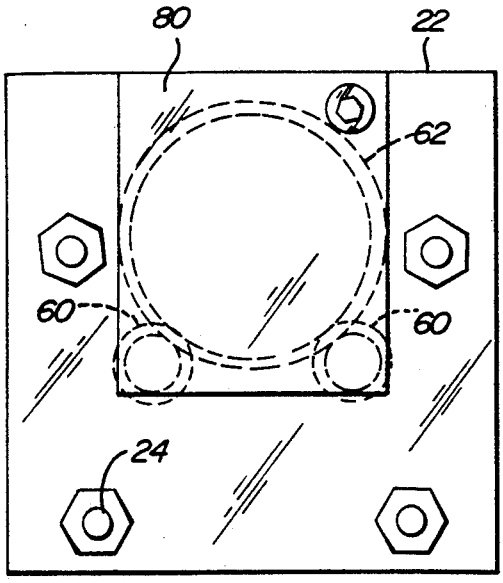
FIG - 7

PISTON LOCK FOR POWER CYLINDERS

BACKGROUND OF THE INVENTION

This invention relates to power cylinders operated by fluid pressure and more particularly to a fluid pressure power cylinder including means to securely lock the piston in a desired position of the piston.

Power cylinders, either pneumatically actuated or hydraulically actuated, find many applications in modern industry. For example, power cylinders are utilized to advance the slide of a tool head in a machine tool so as to bring the cutting tool to a position to operate on a workpiece. If the piston is not locked in its position of adjustment, the associated tool may bounce back and forth or chatter when it is moved against and into the work. As a further example, power cylinders are also conventionally used to operate work holding clamps. It is essential in these situations that the cylinder hold the workpiece securely and that it maintain a holding force on the work, sometimes for long periods of time and sometimes regardless of variations in the size of the work due to permissible work tolerances or other factors. For example, parts such as aircraft wings or the like are sometimes clamped in position and left for days while different machining and assembling operations are performed thereon. It is important in these cases that the power clamps used to hold the part maintain full pressure continuously and that pressure not be relieved or even reduced appreciably at any clamp during the entire period.

It is important therefore, in these and other applications, that the power cylinder include means to ensure that the piston, and thereby the associated tool or clamp, maintains its position of adjustment irrespective of forces exerted against the associated tool or clamp and irrespective of pressure losses in the cylinder.

Various devices have been proposed to allow the piston to be locked in its position of adjustment. One such device, shown in U.S. Pat. No. 3,576,151, includes a ring which is rotated following movement of the piston to its full stroke position to engage pins carried by the piston and thereby lock the piston in its position of adjustment irrespective of any subsequent loss of pressure in the system. Whereas this piston lock arrangement has been generally satisfactory, it does not provide the ability to lock the piston over any significant range of piston positions but rather provides locking only in the full stroke position of the piston.

SUMMARY OF THE INVENTION

The present invention is directed to the provision of a power cylinder having an improved piston lock arrangement which allows locking of the piston over a significant range of piston positions.

According to the invention, the power cylinder includes a cylinder housing defining an axial bore; a piston mounted in the bore for movement through a stroke; fluid pressure means operative to move the piston through a first portion of its stroke; and thread means operative to move the piston through a second portion of its stroke. This arrangement allows the piston to be moved under fluid pressure rapidly through a rapid advance portion of its stroke whereafter the thread means may be actuated to selectively advance the piston through the second portion of its stroke and stop and lock the position in any desired position of adjustment.

According to a further feature of the invention, the power cylinder includes a guide rod extending axially in the bore of the cylinder housing; the piston is mounted on the guide rod for reciprocal movement in the bore along the guide rod; means are provided to rotate the guide rod; and the thread means are provided by coacting thread means on the guide rod and on the piston. With this arrangement, the piston may be rapidly advanced by fluid pressure along the guide rod whereafter the coacting thread means on the guide rod and piston may be utilized upon rotation of the guide rod to move the piston selectively through the lock adjustment portion of its stroke.

According to a further feature of the invention, the guide rod includes an unthreaded portion and a threaded portion; and the piston includes an internally threaded aperture freely passing the unthreaded guide rod portion and threadably coacting with the threaded guide rod portion. This arrangement allows the piston to advance in the bore of the cylinder in response to rotation of the guide rod following engagement of the threaded portion of the guide rod with the internally threaded aperture in the piston at the end of the fluid pressure actuated rapid advance portion of the piston stroke.

According to a further feature of the invention, two guide rods are positioned in the cylinder housing bore in parallel spaced relation with each rod including an unthreaded portion and a threaded portion, and the piston includes a pair of internally threaded apertures slidably passing the unthreaded portions of the respective guide rods and threadably coacting with the threaded portions of the respective guide rods. This arrangement provides positive guidance for the piston during its fluid pressure rapid advance stroke portion and further provides positive, uniform threaded advance of the piston during the lock adjustment portion of its stroke.

According to a further feature of the invention, each of the guide rods includes means defining a driven gear and the rotating means for the guide rods comprises a drive gear meshingly engaging the driven gears on the guide rods together with means for rotating the drive gear. This arrangement provides a convenient means of rotating the guide rods and ensures that the guide rods will always be rotated in unison so as to maintain uniform, consistent threaded engagement of the threaded portions of the guide rods with the internally threaded apertures in the piston.

In one embodiment of the invention, the means for rotating the drive gear comprises an air motor having an output shaft drivingly coupled to the drive gear and in another embodiment the means for rotating the drive gear comprises a fluid pressure driven rack engaging the periphery of the drive gear.

According to a further feature of the invention, the internally threaded apertures in the piston are defined in a drive portion of the piston and the piston further includes a guide portion defining smooth walled apertures coaxial with the threaded apertures and slidably receiving the unthreaded guide rod portions. This arrangement allows the piston to guide smoothly and positively along the guide rods during the pressure actuated, rapid advance portion of the piston stroke and allows the internally threaded apertures on the piston to move into positive driving engagement with the threaded portions of the guide rods at the end of the fluid pressure rapid advance portion of the stroke.

BRIEF DESCRIPTION OF THE DRAWINGS

FIG. 1 is a perspective view of a power cylinder according to the invention;

FIG. 6 is a detail view showing details of the gear layout seen in FIG. 5;

FIG. 7 is an end view looking in the direction of the arrow 7 in FIG. 4;

DETAILED DESCRIPTION OF THE PREFERRED EMBODIMENTS

Figure 2:
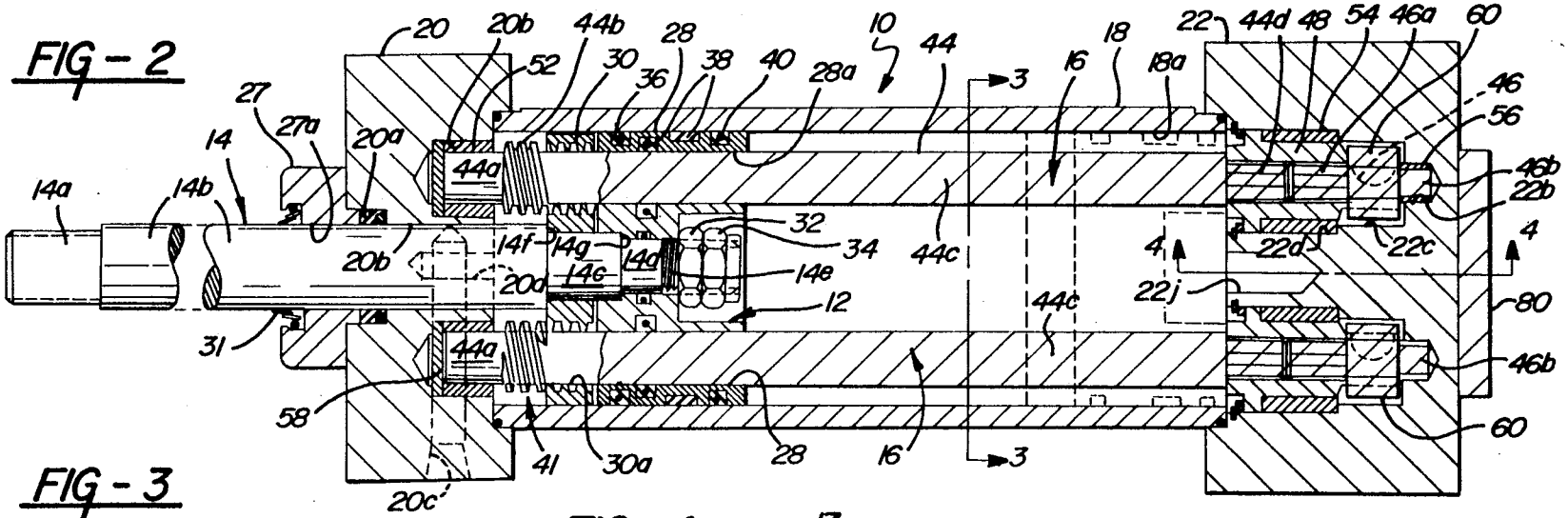
FIG. 2 is a cross-sectional view taken on line 2—2 of FIG. 1.
Figure 5:
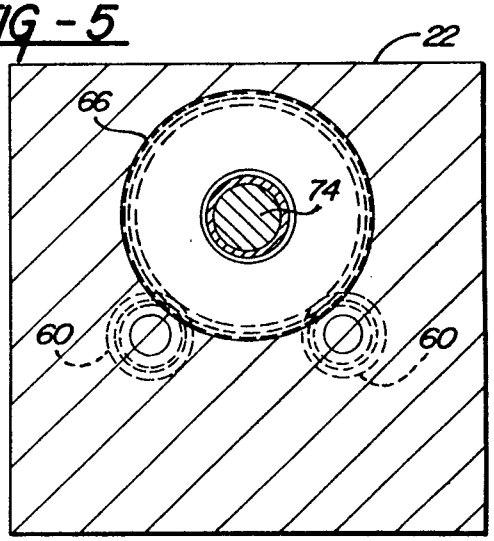
FIG. 5 is a cross-sectional view taken on line 5—5 of FIG. 4.
Figure 4:
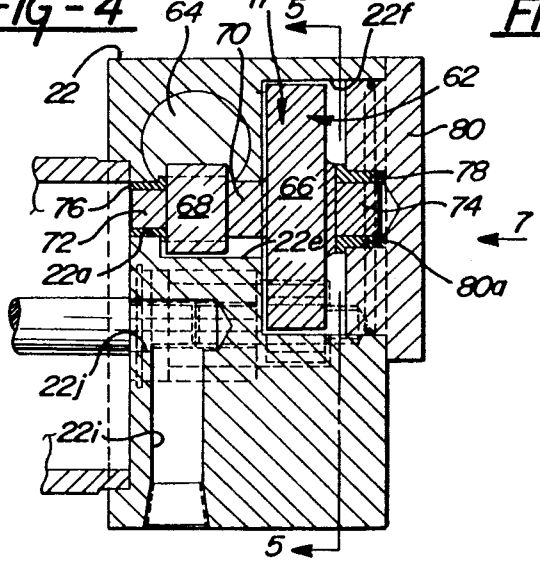
FIG. 4 is a cross-sectional view taken on line 4—4 of FIG. 3.

The power cylinder of the FIGS. 1–7 embodiment includes a cylinder housing 10, a piston 12, a piston rod 14, a pair of guide rod assemblies 16, and a drive assembly 17.

Cylinder housing 10 includes a cylindrical tubular member 18 defining an axial bore 18*a*, a head block 20, and a tail block 22. Four tie rods 24 extend through suitable passages in the head block and the tail block and coact with nuts 26 to clamp the head block and the tail block to the opposite ends of cylinder 18 to form the cylinder housing 10. A bushing 27 is seated in a bore 20*a* in the front face of head block 20.

Piston 12 includes a guide member 28 and a drive member 30. Guide member 28 includes a pair of diametrically opposed smooth bores or apertures 28*a* extending axially through the guide member 28 and drive member 30 includes a pair of diametrically opposed threaded bores or apertures 30*a* extending through the drive member in respective coaxial alignment with unthreaded apertures 28*a*.

Piston rod 14 includes a free front end portion 14*a* for attachment of a tool, clamp or the like; a main body portion 14*b* passing slidably through a wiper seal 31 carried by bushing 27, through the central bore 27*a* of bushing 27, and through a central bore 20*b* in head block 20; a reduced diameter portion 14*c*; a reduced diameter portion 14*d*; and a threaded rear end portion 14*e*.

Piston 12 is assembled to piston rod 14 with piston drive member 30 seated on reduced diameter piston rod portion 14*c* against a shoulder 14*f* and piston rod guide portion 28 positioned on reduced diameter piston rod portions 14*c* and 14*d* in coaction with a shoulder 14*g*. Nuts 32 and 34 threadably engage piston rod threaded end 14*e* to maintain piston rod members 28, 30 in clamped position on piston rod 14. Annular seals 36, 38 and 40 positioned in annular grooves on the external periphery of piston guide member 28 sealingly coact with bore 18*a* in known manner to preclude fluid leakage past the piston between pressure chambers 41 and 42 defined forwardly and rearwardly of the piston within cylindrical member 18.

Each guide rod assembly 16 includes a forward rod 44 and a rear rod 46.

Each forward rod 44 includes a forward journal portion 44*a*, a threaded portion 44*b*, a smooth unthreaded portion 44*c*, and a rear spline portion 44*d*. Each rear rod 46 includes a forward spline portion 46*a* and a rearward journal portion 46*b*. Each forward rod 44 is coupled to the respective rearward rod 46 by an internally splined coupler 48. In assembled relation, each rod 44 extends within bore 18*a* from front to rear of the cylinder housing with journal portion 44*a* received in a bushing 52 positioned in a bore 20*b* in head block 20; each coupler 48 is journalled in a bushing 54 received in a bore 22*a* in tail block 22; and each journal portion 46*b* is received in a bushing 56 received in a bore 22*b* in tail block 22. A thrust wear plate 58 in each head block bore 20*b* absorbs the forward thrust loading of the guide rod assemblies.

Drive assembly 17 includes a pair of spur gears 60, a central gear 62, and a rack 64. Each spur gear 60 is keyed to a respective rear rod 46 between forward spline portion 46*a* and rearward journal portion 46*b*.

Gear 62 includes a large central gear 66 having spur teeth matching the spur teeth on spur gears 60; a small gear 68 having spur teeth and connected to gear 66 by a shaft portion 70; a forward journal portion 72; and a rear journal portion 74. Gear 62 is mounted in tail block 22 with forward journal portion 72 mounted in a bushing 76 received in a bore 22*d* in the tail block, small gear 68 positioned in a bore 22*e* in the tail block, large gear 62 positioned in a bore 22*f* in the tail block and meshingly engaging spur gear 60, and rear journal portion 74 positioned in a bushing 78 received in a central bore 80*a* defined in the front face of a cover plate 80 positioned at the rear face of tail block 22 and closing bore 22*f*.

Rack 64 is positioned in a bore 22*g* extending transversely through tail block 22. Bore 22*g* is closed at one end by a screw cap 67 having a central pressure fitting or aperture 67*a*, and is closed at its other end by a screw cap 68 having a central pressure fitting or aperture 68*a*. The lower face of rack 64 includes a plurality of rack teeth 68.

Drilled passages 22*h,i,j* in tail block 22 coact to define a fluid passage extending from the exterior of the tail block to pressure chamber 42 defined rearwardly of piston 12 and drilled passages 20*c* and 20*d* in head block 20 coact to define a fluid passage extending from the exterior of head block 20 to the pressure chamber 41 defined forwardly of piston 12.

Piston 12, at the start of a work cycle, would typically be in the retracted or dotted line position as seen in FIG. 2. To initiate a work cycle, pressure fluid is introduced through passages 22*h,i* and *j* into pressure chamber 42 to apply pressure to the rear face of the piston and to cause the piston to move forwardly or to the left as viewed in FIG. 2 through a rapid advance, pressure fluid portion of its stroke with the piston guiding during its forward movement on rod portions 44*c* and, specifically, the smooth apertures or bores 28*a* of piston guide member 28 slidably guiding on smooth rod portions 44*c*.

Figure 3:
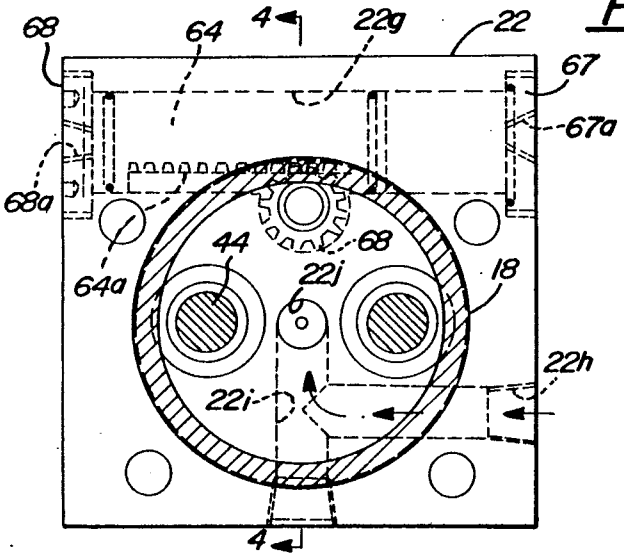
FIG. 3 is a cross-sectional view taken on line 3—3 of FIG. 2.

The piston moves forwardly in the bore 18*a* through 10 its rapid advance portion of its stroke under the influence of the pressure fluid until piston drive member 30 encounters threaded portions 44*b* of rods 44, whereupon a pressure buildup in chamber 42 is suitably sensed by means (not shown) and pressurized fluid is thereupon introduced through fitting 68*a* to act against the left face of rack 64 as viewed in FIG. 3 and move the rack to the right. As the rack moves to the right, the rack teeth 64*a* coact with the spur teeth on gear 68 to rotate gear 62.

As gear 62 rotates, central gear 66 rotates and meshingly engages the spur teeth on spur gears 60 so as to rotate shafts 46 and thereby, through couplers 48, the shafts 44. As the shafts 44 are rotated in unison, the internal threads in apertures 30*a* in the piston drive member 30 threadably coact with the external threads on the threaded portions 44*b* of the rods 44 further to the left with a threading action to its final desired position as determined, for example, by contact with a suitable reference tool or surface, at which time a further buildup of pressure in chamber 42 is sensed and the delivery of pressure fluid through port 68*a* is thereby terminated to thereby terminate the movement of the rack 64, the rotation of the guide rod assemblies 16, and the forward movement of the piston and piston rod.

Once the free end 14*a* of the piston rod has reached its desired final position of threaded adjustment, the pressure in chamber 42 may be relieved and the threaded coaction of the internal threads in piston drive member 30 and the external threads of rod portions 44*b* will coact to lock the free end of the piston, and thereby the associated tool or clamp, in its adjusted position.

Figure 8:
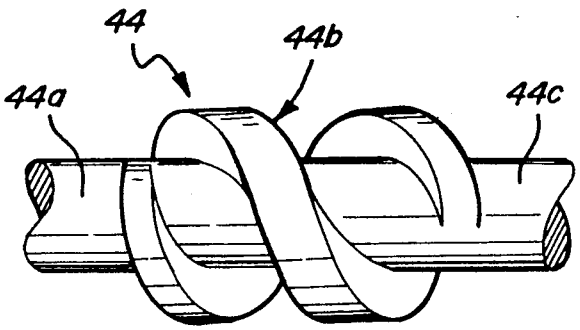
FIG. 8 is a fragmentary view of a guide rod utilized in the power cylinder of FIGS. 1–7.

The power cylinder as seen in FIG. 2 is intended to provide a total piston stroke of approximately 6 inches with the first 5½ inches of this stroke comprising a rapid advance stroking movement under fluid pressure and the final ½ inch comprising a lock adjustment stroke under threaded coaction. Although various threads may be utilized in apertures 30*a*, in piston drive member 30, and along rod threaded portions 44*b*, best results are achieved by the use of a double helix thread as best seen in FIG. 8.

For example, and not by way of limitation, cylinder 18 may provide a 3¼ inch bore; gears 60 may have 12 teeth with a pitch of 16; gear 68 may have 14 teeth with a pitch of 16; gear 16 may have 12 teeth with a pitch of 16; and the double helix threads provided on rod portions 44*b* and internally in apertures 30*a* of piston drive member 30 may comprise an acme thread with a ¾ inch pitch diameter and an 18 degree thread angle. With these dimensions and configurations, movement of rack 64 through 1.3744 inches results in the movement of piston 12 through a ½ inch lock adjustment stroke. Since the described helical threads provide approximately 1 inch of linear movement per revolution of the rods 44, the full range of lock adjusting movement of the piston is provided within ½ revolution of the rods 44.

When it is no longer desired to maintain the free end of the piston rod in a locked disposition, pressurized fluid is introduced into port 66*a* to move rack 64 to the left as viewed in FIG. 3 so as to rotate rods 44 in a sense to move piston 12 to the solid line position of FIG. 2 in which the internal threads in aperture 30*a* have disengaged from threaded rod portions 44*b*, whereafter pressure fluid is introduced through ports 20*c*, 20*d* into pressure chamber 41 to moVe the piston rearwardly through the rapid movement, fluid pressure portion of its stroke to its dotted line position as seen in FIG. 2, whereupon the delivery of pressure fluid through ports 20*c*, 20*d* is terminated.

Figure 9:
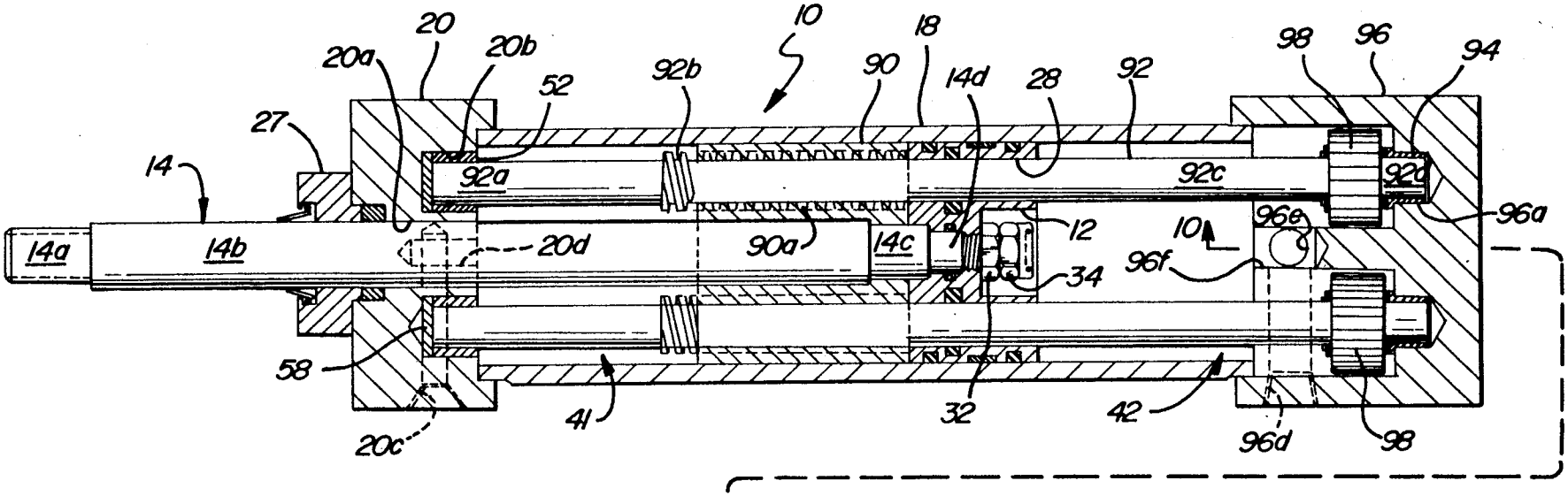
FIG. 9 is a cross-sectional view of a modified form of the invention power cylinder.
Figure 9:
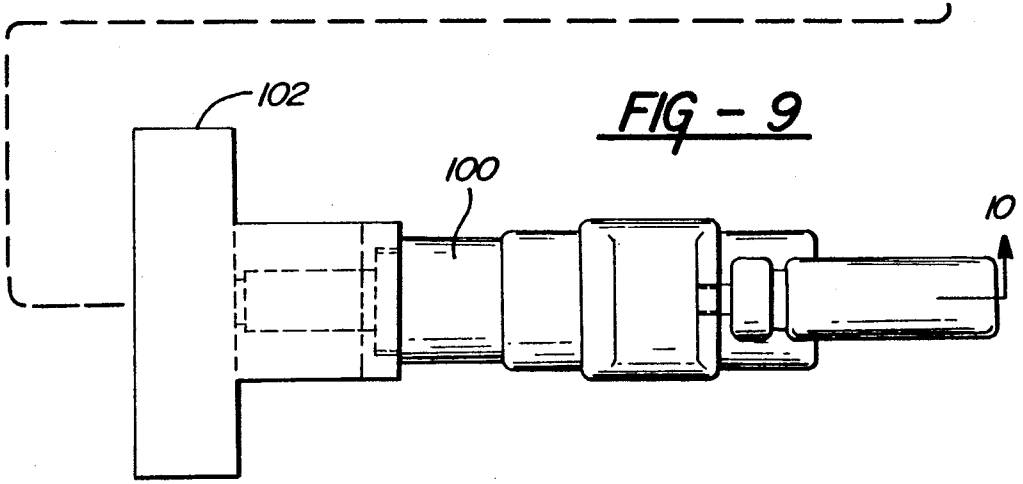
Figures 10, 11:
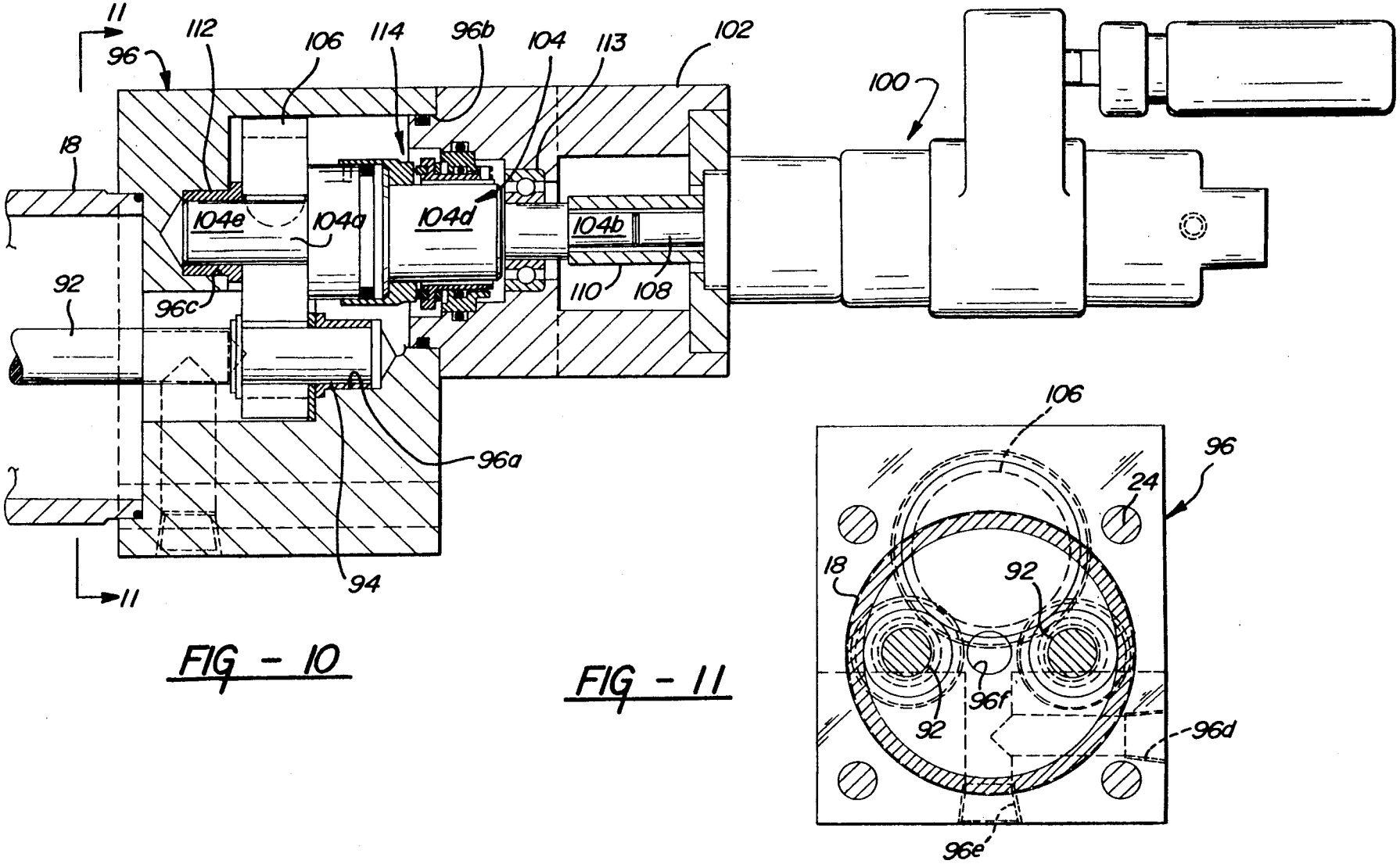
FIG. 10 is a cross-sectional view taken on line 10—10 of FIG. 9.
FIG. 11 is a cross-sectional view taken on line 11—11 of FIG. 10.

The power cylinder seen in FIGS. 9–11 is generally similar to the power cylinder of the FIGS. 1–8 embodiment with the exception that the cylinder is designed for a relatively long lock adjustment stroke as compared to the total stroke and the rotation of the guide rods is achieved with an air motor as opposed to the rack and pinion arrangement of the FIGS. 1–8 embodiment.

The relatively long lock adjustment stroke portion is achieved by the use of a piston 12 having a drive portion 90 that is substantially longer than the drive portion 30 of the piston of the FIGS. 1–8 embodiment and which is internally helically threaded throughout its entire axial length of the through apertures 90*a* so as to coact with the threaded portion on the guide rods to provide a relatively long adjustment stroke.

Each guide rod assembly in the FIGS. 9–11 embodiment includes a single rod 92 having a forward journal portion 92*a* received in a bushing 93 positioned in a bore 20*a* in head block 20, a threaded portion 92*b*, a main body smooth unthreaded portion 92*c* slidably received in piston bores 28*a*, and a rear journal portion 92*d* received in a bushing 94 positioned in a bore 96*a* in tail block 96.

The drive means for rotating the rods 92 includes a pair of spur or planet gears 98 respectively keyed to guide rods 92 immediately forwardly of journal portions 92*d*; an air motor 100 suitably mounted at the rear face of a mounting block 102 mounted to the rear face of tail block 96 and closing an aperture 96*b* in the rear face of the tail block; a drive shaft 104; and a central or sun gear 106 keyed to a forward portion 104*a* of drive shaft 104 and meshingly engaging planet gears 98 so that rotation of gear 106 in response to actuation of air motor 100 results in the rotation in unison of shafts 92 and the threaded advance of piston 12 in coaction with the threaded portions 92*b* on the guide rod 92.

Air motor 100 may take various forms and may for example be of the type available from the Alar Company, Inc., of Sterling Heights, Mich. under Catalog No. 8231-9B. The output shaft 108 of air motor 100 is keyed to a coupler 110 which in turn is keyed to the rear portion 104*b* of drive shaft 104. The forward journal portion 104*e* of drive shaft 104 is received in a bushing 112 positioned in a bore 96*c* in tail block 96. The rearward end of drive shaft 104 is journalled in a ball bearing 112 mounted in mounting block 102 and the main body portion 104*d* of drive shaft 104 coacts with a seal 114 mounted in mounting block 102 to preclude the transmission of fluid from the pressure chamber of the cylinder to the exterior of the tail block. Seal 114 may for example be of the type available from Engineered Products Division of E. G. & G. Sealol, Inc. of Providence, R.I. as Seal Assembly 71736 with mating Ring 57547.

The operation of the power cylinder of the FIGS. 9–11 embodiment is generally similar to the operation of the power cylinder of the FIGS. 1–8 embodiment with the exception that, as previously noted, the lock adjustment or slow advance portion of the stroke of the piston is relatively long as compared to the lock adjustment stroke portion of the FIGS. 1–8 embodiment so that a greater range of locking adjustment of the free end 14*a* of the piston rod, and of the associated tool or clamp, is possible.

For example, the power cylinder seen in FIG. 9 may be arranged to provide a total 6 inch piston stroke with the first 3 inches of the stroke comprising a rapid advance under fluid pressure and the final 3 inches of the stroke comprising a lock adjustment movement achieved by the coaction of guide rod threaded portions 92b and the internal threads in aperture 90a of piston drive portion 90. As with the FIGS. 1-8 embodiment, the threads of rod threaded portion 92b and the internal threads in piston drive portion apertures 90a are preferably of the double helix type with an acme thread configuration and may, for example, be configured to provide 1 inch of linear movement of the piston in response to each revolution of the guide rods.

As with the FIGS. 1-8 embodiment, pressure may be delivered to the pressure chamber 42 rearwardly of the piston through a series of drilled passages 92d, 92e and 92f and may be delivered to the pressure chamber 41 forwardly of the piston through aligned drilled passages 20c, 20d. Further as with the FIG. 1-8 embodiment, the air motor 100 may be actuated in response to a predetermined sensed pressure in pressure chamber 42 indicating that the piston has been moved forwardly by the pressure fluid through the rapid advance portion of its stroke to a position in juxtaposition to the threaded portions 92b of the guide rods. Actuation of the air motor rotates the rods 92 and produces forward threaded adjusting movement of the piston to its final desired adjusted position. The final position may be determined by contact of the associated tool or clamp with a reference surface which contact generates an increased pressure in pressure chamber 42 for transmission to the air motor controls to terminate operation of the air motor.

The piston will be maintained in any position of threaded adjustment without the need to maintain pressure in chamber 42. When it is desired to return the piston to its rest or retracted position, air motor 100 is actuated in a reverse sense to rotate rods 92 in a reverse sense and threadably back the piston 12 to the right as viewed in FIG. 8 until the internal threads in the piston drive portion 90 have disengaged from the threaded portions 92b of the guide rods, whereupon pressure fluid may be introduced into pressure chamber 41 through passages 20c, 20d to move the piston through its rapid pressure actuated stroke portion and return the piston to its rest position in preparation for a new work cycle.

In both of the disclosed embodiments, the working fluid introduced into the pressure chambers 41, 42 may be either air or hydraulics, and the working fluid utilized to move the rack of the FIGS. 1-8 embodiment may also be either air or hydraulics.

The invention will be seen to provide a power cylinder with a piston lock wherein the locking condition may be achieved over a relatively long range of axial movement of the piston and wherein the lock, in any position of locking adjustment, is positive and firm and will hold the associated tool or clamp without need to maintain pressure in the pressure chamber of the power cylinder.

Whereas preferred embodiments of the invention have been illustrated and described in detail, it will be apparent that various changes may be made in the disclosed embodiments without departing from the scope or spirit of the invention.

What is claimed is:

1. A power cylinder comprising:

a cylinder housing defining an axial bore;

a guide rod extending axially in said bore;

a piston mounted on said guide rod for movement in said bore along said guide rod through a stroke;

fluid pressure means operative to move said piston along said guide rod through a first portion of said stroke; and thread means operative to move said piston along said guide rod through a second portion of said stroke.

2. A power cylinder according to claim 1 wherein:

said thread means includes thread means on said piston and thread means on said guide rod coacting with said piston thread means in response to rotation of said guide rod to move said piston through said second portion of said stroke.

3. A power cylinder according to claim 2 wherein:

said piston thread means comprises internal threads in an aperture in said piston coating with external threads on said guide rod.

4. A power cylinder comprising:

a cylinder housing defining a front end wall, a rear end wall, and a cylindrical bore extending axially between said end walls;

a pair of guide rods extending axially through said bore between said end walls in parallel, spaced relation;

a piston positioned in said bore and including a pair of spaced apertures respectively passing said guide rods;

a piston rod rigid with said piston and extending through said front end wall;

means for delivering pressure fluid to said bore so as to move said piston axially in said bore along said guide rods;

means for rotating said guide rods;

means operative in response to rotation of said guide rods to advance said piston axially in said bore independently of the action of the pressure fluid;

each of said guide rods including a smooth unthreaded portion an da threaded portion;

each of said apertures including a guide portion slidably receiving the unthreaded portion of a respective guide rod and a threaded portion for coaction with the threaded portion of a respective guide rods; and said advancing means being provided by the threaded coaction of said threaded portions of said apertures with said threaded portions of said guide rods.

5. A power cylinder according to claim 4 wherein:

said rotating means comprises means defining a spur gear on each guide rod and a central drive gear meshingly engaging said spur gear.

6. A power cylinder according to claim 5 wherein:

said threaded portions of said guide rods are provided proximate said front end wall;

said piston is mounted on said guide rods with said threaded portions of said apertures between said guide portions of said apertures and said front end wall; and said spur gears are provided on said guide rods proximate said rear end wall.

7. A power cylinder comprising:

a cylinder housing defining an axial bore;

a guide rod extending axially in said bore;

a piston mounted on said guide rod for reciprocal movement in said bore along said guide rod;

means operative in response to rotation of said guide rod to advance said piston axially in said bore; and means operative in response to delivery of pressure fluid to said bore to move said piston axially in said bore along said guide rod independently of the operation of said advancing means.

8. A power cylinder according to claim 7 wherein:
said advancing means comprises coacting threads on said piston and on said guide rod.

9. A power cylinder comprising:
a cylinder housing defining an axial bore;
a guide rod extending axially in said bore;
a piston mounted on said guide rod for reciprocal movement in said bore along said guide rod;
means for delivering pressure fluid to said bore to move said piston axially in said bore along said guide rod;
means operative in response to rotation of said guide rod to advance said piston axially in said bore independently of the action of the pressure fluid;
said guide rod including an unthreaded portion and a threaded portion;
said piston including an internally threaded aperture passing said unthreaded guide rod portion and threadably coating with said threaded guide rod portion; and
said advancing means comprising the threads in said piston aperture in coaction with the threads on said threaded guide rod portion.

10. A power cylinder according to claim 9 wherein:
said guide rod comprises a first guide rod;
said cylinder further includes a second guide rod extending axially in said bore in parallel spaced relation to said first guide rod and including an unthreaded portion and a threaded portion; and
said piston includes another internally threaded aperture slidably passing said unthreaded portion of said second guide rod and threadably coacting with said threaded portion of said second guide rod.

11. A power cylinder according to claim 10 wherein:
each of said guide rods includes means defining a driven gear; and
said rotating means comprises a drive gear meshingly engaging said driven gears on said guide rods and means for rotating said drive gear.

12. A power cylinder according to claim 11 wherein:
said means for rotating said drive gear comprises an air motor having an output shaft drivingly coupled to said drive gear.

13. A power cylinder according to claim 11 wherein:
said means for rotating said drive gear comprises a rack engaging the periphery of said drive gear and operative in response to linear movement of said rack to rotate said drive gear and thereby rotate said driven gears to rotate said guide rods and advance said piston.

14. A power cylinder according to claim 9 wherein:
said internally threaded aperture is defined in a drive portion of said piston; and
said piston further includes a guide portion defining a smooth walled aperture coaxial with said threaded aperture and slidably receiving said unthreaded guide rod portion.

15. A power cylinder according to claim 14 wherein:
said piston is mounted on said guide rod with said piston guide portion slidably mounted on said guide rod unthreaded portion and said piston drive portion positioned between said piston guide portion and said guide rod threaded portion.

16. A power cylinder according to claim 15 wherein:
said guide rod threaded portion is proximate one end of said guide rod; and
said rotating means includes a spur gear defined proximate the other end of said guide rod.

17. A power cylinder comprising:
a cylinder housing defining a front end wall, a rear end wall, and a cylindrical bore extending axially between said end walls;
a pair of guide rods extending axially through said bore between said end walls in parallel, spaced relation;
a piston positioned in said bore and including a pair of spaced apertures respectively passing said guide rods;
a piston rod rigid with said piston and extending through said front end wall;
means for rotating said guide rods;
means operative in response to rotation of said guide rods to advance said piston axially in said bore; and
means operative in response to delivery of pressure fluid to said bore to move said piston axially in said bore along said guide rods independently of the operation of said advancing means.

18. A power cylinder comprising:
a cylinder housing defining an axial bore;
a piston mounted in said bore for movement through a stroke and including an aperture having internal threads;
a rod mounted for rotation in said bore about an axis parallel to the central axis of said bore, passing through said piston aperture, and including external threads for threaded coaction with said piston threads;
fluid pressure means for moving said piston in said bore through a portion of its stroke;
said rod including a smooth unthreaded portion and a threaded portion defining said external threads; and
said piston aperture including a smooth unthreaded portion slidably guiding on said unthreaded portion of said rod and a threaded portion defining said internal threads.

* * * * *

UNITED STATES PATENT AND TRADEMARK OFFICE

CERTIFICATE OF CORRECTION

PATENT NO. : 5,020,418

DATED : June 4, 1991

INVENTOR(S) : Jack J. Sendoykas

It is certified that error appears in the above-identified patent and that said Letters Patent is hereby corrected as shown below:

Column 4, Line 44, After teeth and before 68. please insert -- 64a sized to meshingly engage with the spur teeth on gear --.

Column 4, lines 64&65, Please delete "through 10 its" and insert -- through its --.

Column 5, Line 62, Please delete "moVe" and insert -- move --.

Column 6, Line 45, Please delete "112" and insert -- 113 --.

Column 8, Line 36, Please delete "an da" and insert -- and a --.

Signed and Sealed this

Thirteenth Day of October, 1992

*Attest:*

DOUGLAS B. COMER

*Attesting Officer*

*Acting Commissioner of Patents and Trademarks*